US008313396B1

(12) United States Patent
Mailman

(10) Patent No.: US 8,313,396 B1
(45) Date of Patent: Nov. 20, 2012

(54) TENNIS BALL VACUUM COLLECTOR

(76) Inventor: Charles J. Mailman, Lexington, MA (US)

( * ) Notice: Subject to any disclaimer, the term of this patent is extended or adjusted under 35 U.S.C. 154(b) by 0 days.

(21) Appl. No.: 13/452,206

(22) Filed: Apr. 20, 2012

Related U.S. Application Data

(60) Provisional application No. 61/477,266, filed on Apr. 20, 2011.

(51) Int. Cl.
*A63B 47/02* (2006.01)

(52) U.S. Cl. ..... 473/460

(58) Field of Classification Search ..... 473/436, 473/460; 294/19.1; 406/39, 151; 290/250
See application file for complete search history.

(56) References Cited

U.S. PATENT DOCUMENTS

| | | | | | |
|---|---|---|---|---|---|
| 3,744,653 | A * | 7/1973 | Jensen | 414/471 |
| 3,819,049 | A * | 6/1974 | Koerner et al. | 209/250 |
| 4,002,336 | A | 1/1977 | Beaver et al. | |
| 4,021,037 | A | 5/1977 | Torbet | |
| 4,077,533 | A | 3/1978 | Meyer | |
| 4,112,911 | A * | 9/1978 | Petrick, Sr. | 124/56 |
| 4,116,192 | A * | 9/1978 | Scott | 124/51.1 |
| 4,721,428 | A * | 1/1988 | Rohrer et al. | 414/439 |
| 5,125,654 | A * | 6/1992 | Bruno | 473/460 |
| 5,147,100 | A * | 9/1992 | Frankel | 294/19.2 |
| 5,407,242 | A * | 4/1995 | Beranek | 294/19.2 |
| 6,715,627 | B1 | 4/2004 | Bonner et al. | |
| 6,834,776 | B1 * | 12/2004 | Corvese | 221/277 |
| 6,851,566 | B1 | 2/2005 | Bonner | |
| 6,886,703 | B1 | 5/2005 | Bonner | |
| 7,114,317 | B2 * | 10/2006 | Dunning et al. | 56/202 |
| 7,341,294 | B2 * | 3/2008 | Olmstead | 294/19.2 |
| 7,674,196 | B2 * | 3/2010 | Tsai | 473/460 |
| 8,075,030 | B2 * | 12/2011 | Pearson et al. | 294/19.2 |
| 2006/0068948 | A1 | 3/2006 | Mendoza | |

* cited by examiner

*Primary Examiner* — Raleigh W. Chiu
(74) *Attorney, Agent, or Firm* — John H. Pearson, Jr., Esq; Walter F. Dawson, Esq.; Pearson & Pearson, LLP.

(57) ABSTRACT

A device for quickly picking up numerous tennis balls on a tennis court having a vacuum unit with angled collection members to funnel tennis balls into a location where suction from the vacuum unit draws the balls through tubing and a port into a basket within a chamber of the vacuum unit.

19 Claims, 7 Drawing Sheets

TENNIS BALL VACUUM COLLECTOR

This application claims the benefit of prior Provisional Application No. 61/477,266, filed Apr. 20, 2011, which is herein incorporated by reference.

BACKGROUND OF THE INVENTION

1. Field of the Invention

The present invention relates generally to a device for picking up round balls and more particularly to a tennis ball vacuum collector which increases the speed of picking up numerous tennis balls on a tennis court.

2. Description of Related Art

When a tennis player is receiving a lesson, an instructor will serve the tennis balls to the student, or a tennis player will practice with the aid of an automated tennis ball serving machine. In both cases many balls are distributed on a tennis court. Picking up tennis balls or even baseballs is not a desirable activity because of resulting back aches, and it is just not fun. Tennis ball retrieving devices of the prior art tend to be slower or not efficient in rounding up dispersed tennis balls. Also, certain devices become heavy, particularly hand held basket type devices as they become filled with tennis balls. Other devices of the prior and are as follows:

U.S. Pat. No. 4,002,336 issued Jan. 11, 1977 to Dennis Beaver et al. discloses a table tennis training device for use with a table tennis table and includes a tennis ball catcher having a pocket for collecting the table tennis ball which is then, due to a suction effect, moved from the pocket into a gun to shoot out to a player who is practicing. However, the device is not designed for picking up a plurality of balls on the ground.

U.S. Pat. No. 4,021,037 issued May 3, 1977 to Phillip A. Torbet discloses a tennis practice machine for collecting a projectile such as a tennis ball and launching it through the air whereby a single tennis ball can be kept in continuous operation by the machine to provide uninterrupted practice for a player.

U.S. Pat. No. 5,147,100 issued Sep. 15, 1992 to Edward B. Frankel discloses a ball retrieval device having a main body and a basket for storing retrieved balls. A pair of arms is attached to the main body for funneling balls into the main body, and the balls enter a conveyor mechanism opening and are transported up to a basket. However, the ball retrieval device does not have a vacuum suction means for rapidly drawing balls into the device.

U.S. Pat. No. 5,407,242 issued Apr. 18, 1995 to Kurt G. Beranek discloses a tennis ball retriever having a handle and a collection drum rotatably journalized on the handle. The cylindrical drum has a plurality of axially spaced circumferential tines. Loose tennis balls are grasped by abrasive surfaces of the spaced-apart cylindrical tines and urged into the interior of the collection drum having a hinged door. However, it does not disclose retrieving balls by a vacuum suction device.

SUMMARY OF THE INVENTION

Accordingly, it is therefore an object of this invention to provide a device to easily and quickly pick up numerous balls and load them into a basket within the device.

It is another object of this invention to provide a vacuum collector of tennis balls having collection members to funnel tennis balls into a location for rapid pick up of each of the balls into the vacuum collector.

These and other objects are further accomplished by a tennis ball collector comprising means for generating a vacuum at a port of the ball collector, means for funneling a plurality of balls on a floor to a central location, and cylindrical means for transporting each of the balls from the central location to the port and into the ball collector for storage. The funneling means comprises collection members attached to a support bracket forming an angle for moving the plurality of balls towards the central location for vacuum suctioning each of the tennis balls through the cylindrical means.

The objects are further accomplished by a tennis ball vacuum collector comprising a vacuum device having an internal chamber, a support bracket attached to the vacuum device below an input port, a pair of collection members attached to the support bracket forming an angle for moving tennis balls toward a location adjacent to the support bracket for vacuum suctioning the tennis balls into the internal chamber, and cylindrical means having a portion of a lower end positioned within the support bracket and between the pair of collection members the lower end being open, and an upper end of the cylindrical means extending to the input port. The internal chamber comprises a removable basket. The internal chamber comprises a diverter attached to a bottom of the chamber and extending upward to a height of the input port for diverting the balls as they enter the chamber via the input port. The cylindrical means comprises a first portion extending vertically and a second portion having a right angle section extending horizontally into the input port. The vacuum device comprises a plurality of wheels and a handle to allow the collector to be easily moved along a floor or tennis court. The input port comprises a cylindrical adaptor attached thereto for providing approximately an eleven degree angle transition downward to connect with the horizontal second portion of the cylindrical means. The collection members provide an area of coverage of approximately two to three feet as the collector is moved forward. The vacuum device comprises a window on a side portion of a cover for viewing balls in the internal chamber. The collection members comprise attachment means for enabling the collection members to rotate upward when the collector is not in use.

The objects are further accomplished by a method of making a tennis ball vacuum collector comprising the steps of providing a vacuum device having an internal chamber, attaching a support bracket to the vacuum device below an input port, attaching a pair of collection members to the support bracket forming an angle for moving tennis balls toward a location adjacent to the support bracket for vacuum suctioning the balls into the internal chamber, positioning a cylindrical means having a lower end secured within the support bracket between the pair of collection members, the lower end being open, and an upper end of the cylindrical means extending to the input port. The step of providing a vacuum device having an internal chamber comprises the step of providing a removable basket in the internal chamber. The step of providing a vacuum chamber having an internal chamber comprises the step of attaching a diverter to the bottom of the chamber, the diverter extending upward to a height of the input port for diverting the balls as they enter the chamber via the input port. The step of positioning the cylindrical means comprises the step of extending a first portion of the cylindrical means vertically and extending a second portion of the cylindrical means horizontally into the input port. The step of providing a vacuum device comprises the step of providing a plurality of wheels and a handle on the vacuum device to allow the ball collector to be easily moved along a floor or tennis court. The method comprises the step of providing the input port with a cylindrical adaptor having an approximately eleven degree angle transitioning to meet a horizontal portion of the cylindrical means. The step of attaching a pair of collection members to the support bracket comprises the step of providing an area of coverage of approximately two to three feet as the collector is moved forward. The method further comprises the step of rotating upward each of the collection members when the collector is not in use.

Additional objects, features and advantages of the invention will become apparent to those skilled in the art upon consideration of the following detailed description of the preferred embodiments exemplifying the best mode of carrying out the invention as presently perceived.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENT

Figure 1:
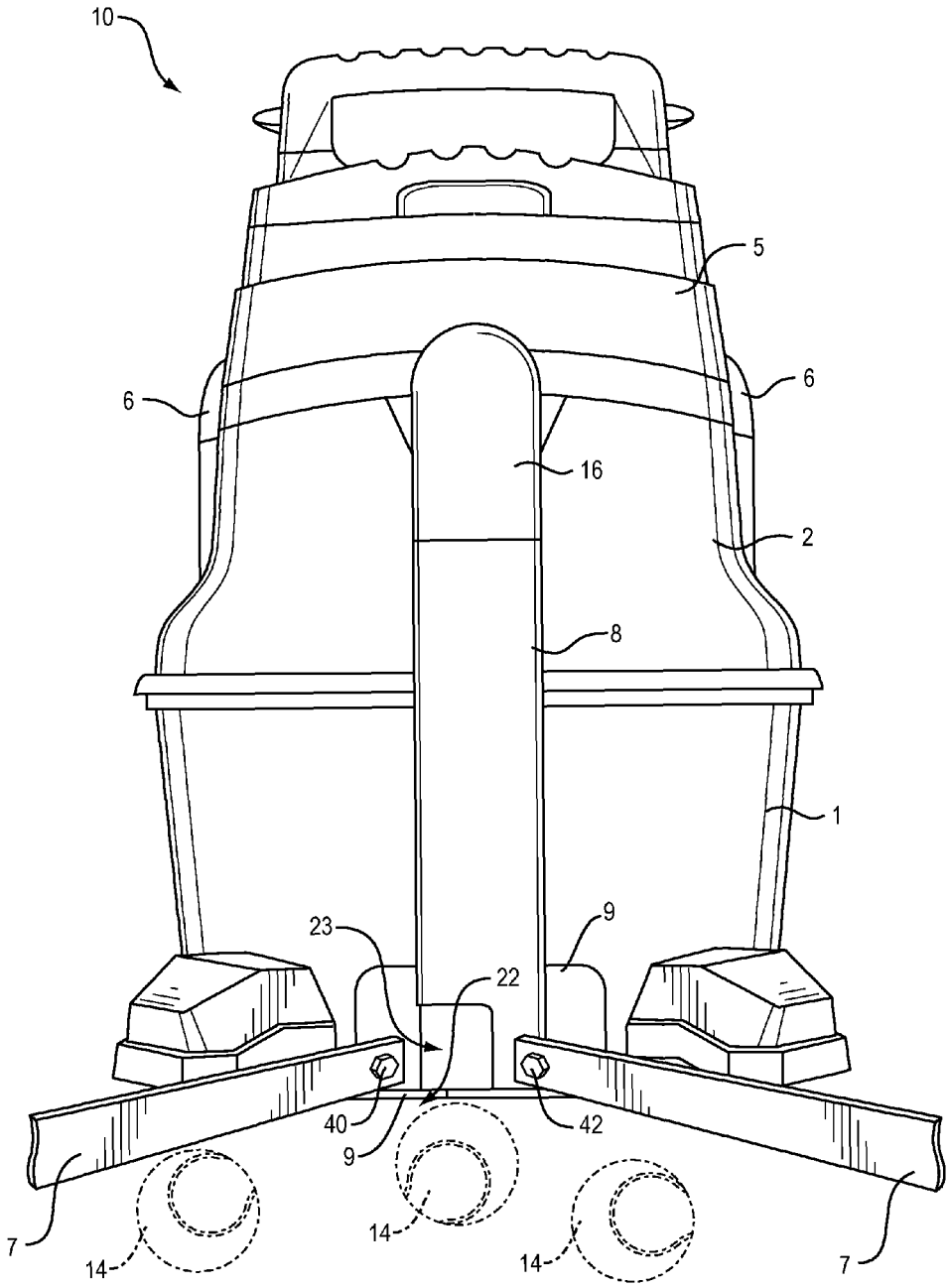
FIG. 1 is a front elevational view of a tennis ball vacuum collector according to the present invention.
Figure 2:
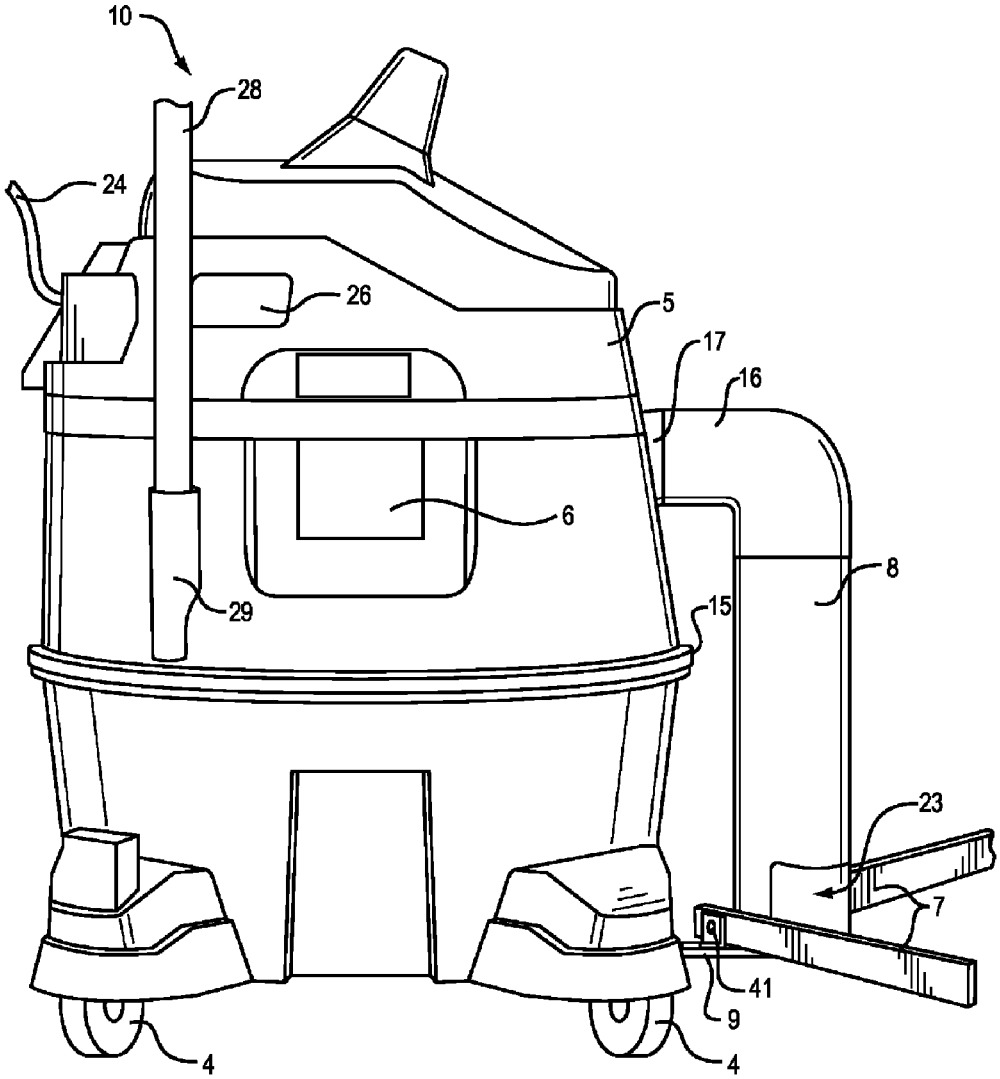
FIG. 2 is a side elevational view of the tennis ball vacuum collector according to the present invention.

Referring to FIG. 1 and FIG. 2, FIG. 1 is a front elevational view of a Tennis Ball Vacuum Collector 10, described herein as "the Collector" which is intended to increase the speed of picking up numerous tennis balls on a tennis court after a prolonged practice session. FIG. 2 is a side elevational view of the tennis ball vacuum collector 10. The Collector 10 utilizes vacuum suction to draw balls into a basket 19 (FIG. 5) inside a vacuum chamber that can subsequently be conveniently emptied into, for example, a Lobster® tennis ball machine hopper (or an analogous holding area of other similar devices) for the next period of tennis practice. The Collector 10 comprises a wet-dry vacuum 13 similar to those used in workshops. The Collector 10 is fitted with a series of tubes 8,16, adaptor 17, and collection members 7 that work together to funnel balls 14 into a central location 22 where the suction from the vacuum 13 will draw balls through the tubing 8, 16 into the vacuum's lower vacuum chamber 1 or hopper. The lower vacuum chamber 1 itself is fitted with a diverter 11 (FIG. 9) to keep entering balls from striking an internal dust filter located on the inside of a cover 5, as well as the lift-out basket 19 with a handle 24 that can be removed and emptied into the Lobster's® ball bin.

Figure 3:
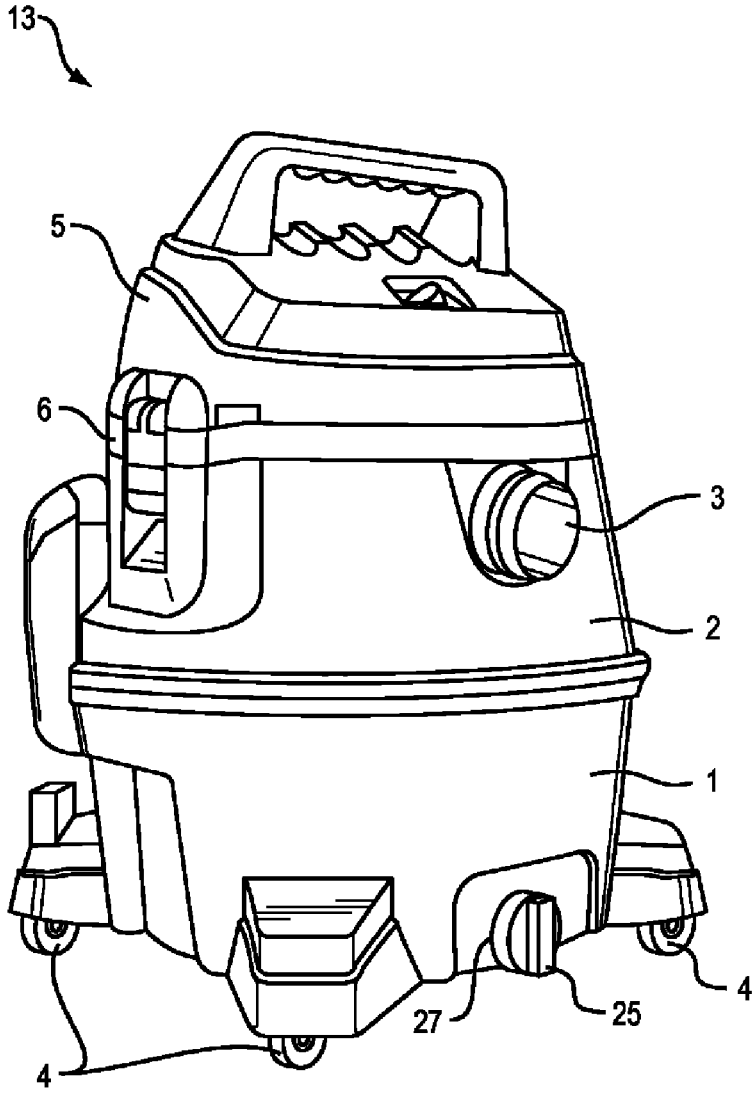
FIG. 3 is a perspective view of a commercial vacuum cleaner.

Referring to FIG. 3, a perspective view of a commercial canister-type vacuum cleaner 13 is shown. The Collector 10 is made using the existing, commercial canister-type vacuum cleaner 13, which is modified to perform as a collector of tennis balls and provide intermediate storage of the balls. The commercial vacuum cleaner 13 chosen is shown in FIG. 3. It has swivel wheels 4 and a handle 28 for pushing it around in a tennis court. It may be embodied by a Model WD14500 14 gallon, 6.0 Peak H.P. Professional Wet/Dry Vacuum manufactured by Ridgid Tool Company of Elyria, Ohio. It is modified as shown in FIG. 1.

Referring now to FIG. 1, it is seen that the Collector 10 will accept tennis balls through a cylinder which has a 3 inch O.D. (2¾ inch I.D.) commercial PVC or clear polycarbonate tube 8, hereafter referred to as polycarbonate, that draws balls vertically from floor level when near a central location 22 formed by two collection members 7, which cause the balls to be suctioned up via tubes 8, 16 into the upper vacuum chamber 2. The collection members 7 are sufficiently long, typically 1 to 1.5 feet long and 1 inch in height, so that an area of at least 2-3 feet is covered on a tennis court and that as the Collector 10 is pushed forward, balls lying within an area 2-3 feet wide will be drawn into the central location 22 at the confluence of the two collection members 7, and from there upward into the vertical portion 8 of the polycarbonate tube, directed from there into the horizontal portion 16 of the tubing (FIG. 2), and finally through an adaptor 17 and into the upper vacuum chamber 2 via input port 3. The wheels 4 in this embodiment are incorporated to allow the Collector 10 to be easily moved along a floor or court without the need for excessive force. As may be seen in FIG. 1, the collection members 7 are suspended a short distance, typically 0.25 inches above the floor by a support bracket 9 to allow movement of the Collector 10 without excessive force.

Referring now to FIGS. 1, 2, and 3, the construction of the polycarbonate tube may be seen. A vertical portion 8 rises parallel to the front face 15 of the vacuum 13, and attaches to a right angle elbow section of the horizontal portion 16, in a manner which provides a vacuum-tight seal such as by using a commonly available cement or tube sealant. The lower end of vertical tube 8 facing away from the support bracket 9 has an opening 23 approximately 3 inches high to enable tennis balls to enter the vertical tube 8. The horizontal portion 16 is inserted via adaptor 17 into an input port 3 (FIG. 3) of the vacuum cleaner 13, which is normally used to attached a hose to pick up dust and dirt during normal operation of the vacuum cleaner 13. Because the input port 3 is angled approximately 11 degrees above horizontal, the adaptor 17 provides a downward transition to meet the horizontal portion of the tube 16. The support bracket 9 supports the vertical member 8 of the polycarbonate tube, so that the entire structure is sufficiently robust to provide for entrance of tennis balls into the interior of the Collector 10. A window 26 is provided in a side wall of the cover 5 to show users the amount of balls collected and the amount of space available.

Figure 7:
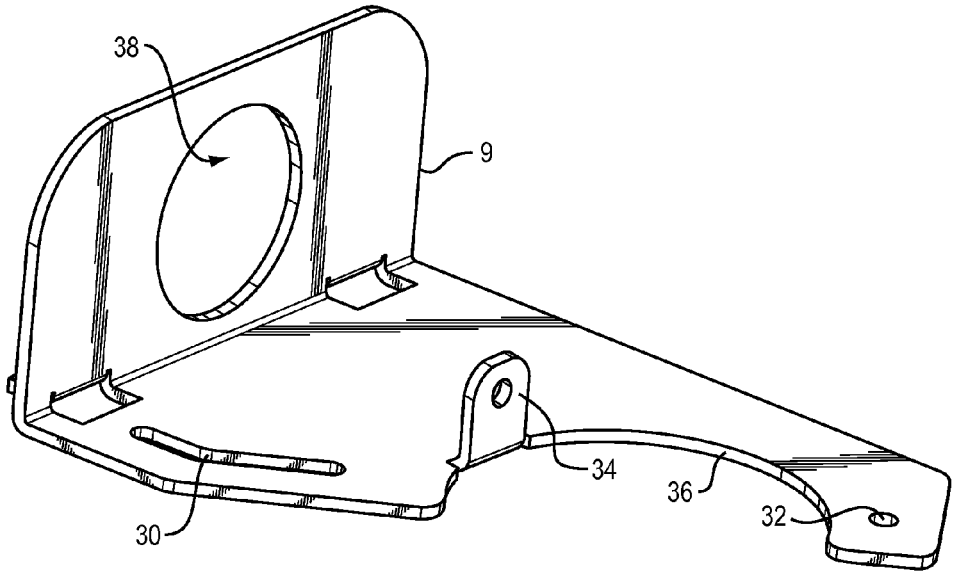
FIG. 7 is a perspective view of a support bracket which secures a vertical portion of tubing to one side of the vacuum collector.

Referring to FIG. 2, FIG. 3, and FIG. 7, FIG. 7 is a perspective view of the support bracket 9 which secures the vertical tubing 8 portion to a side of the vacuum 13 near the bottom. An opening 38 on the upper end of the support bracket 9 fits around a drain tube 27 on a side of the vacuum 13, and a drain plug 25 secures the support bracket 9 to the vacuum 13. The two collection members 7 are mounted to the support bracket 9 at approximately a 90 degree angle between them by means of right angle brackets 41,43. One end of right angle brackets 41, 43 is attached by common machine bolts 40, 42 having shoulders and lock washers and nuts near the ends of each collection member 7. The shoulder on the bolts 40, 42 allows the collection members 7 to be raised approximately 90 degrees when the collector 10 is not in use. The other end of the right angle brackets 41, 43 attaches to the support bracket 9 in slot 30 and hole 32 by common machine bolts or screws and nuts. The slot 30 provides for some angle adjustment between the collection members 7. The support bracket 9 has a semi-circular cut-out 36 for receiving a portion of the vertical tube 8. A flange 34 with a hole is provided on the back edge of the semi-circular cut-out for inserting a screw into the vertical tube 8 to secure it to the lower end of the vacuum 13.

Figure 4:
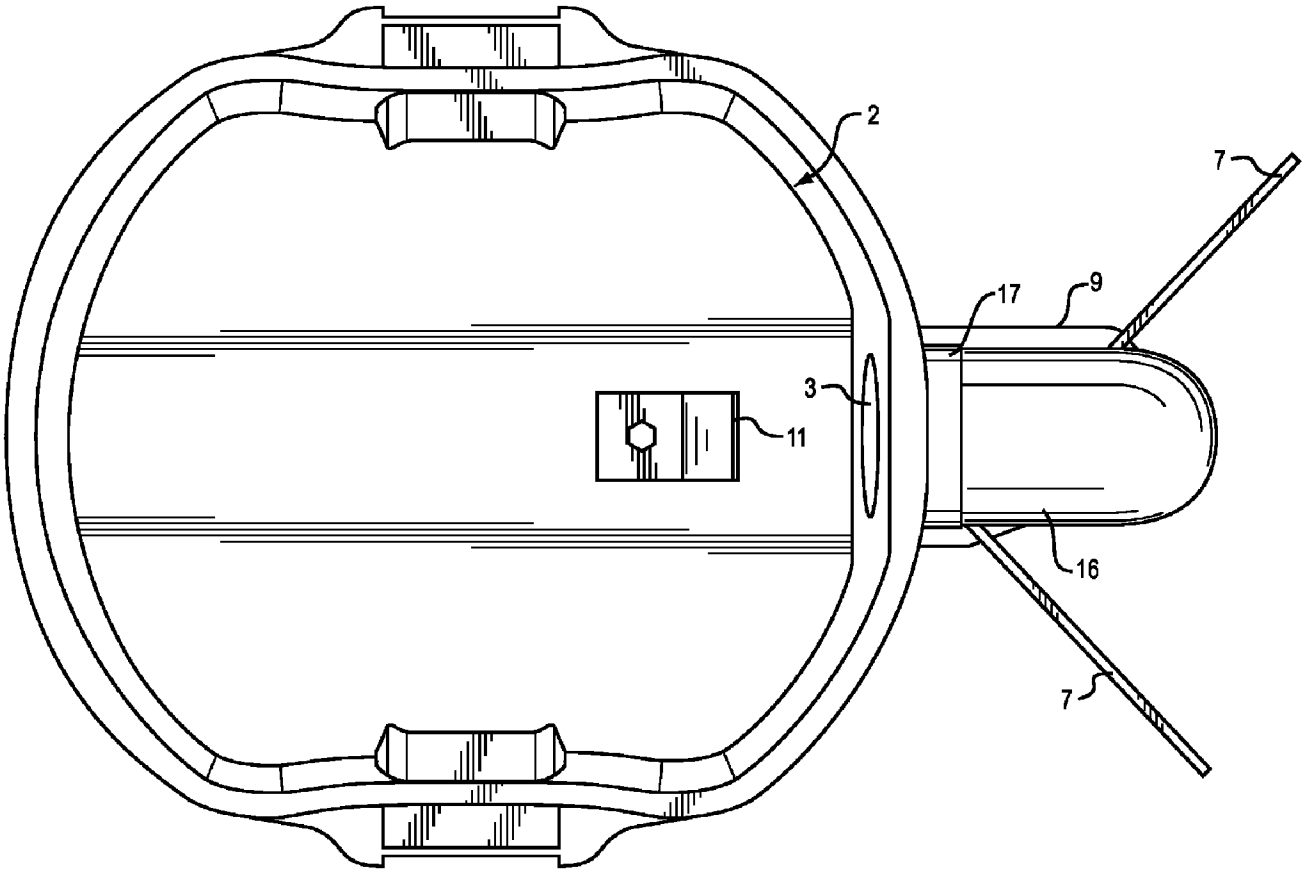
FIG. 4 is a top view of the interior of the lower chamber of the vacuum collector showing a diverter protruding upward from the bottom surface.

Referring now to FIG. 4, a top view of the interior of the chambers 1,2 of the vacuum Collector 10 is shown. Inside the lower vacuum chamber 1 is a flat steel diverter 11, and the diverter 11 is mounted to the bottom of the inside of the lower vacuum chamber 1 in front of the vacuum filter (not shown) in the cover 5 and opposite the input port 3 provided by the commercial version of the vacuum 13. The diverter 11 prevents balls from impacting the vacuum filter as they enter the vacuum chambers 1,2. FIG. 4 further shows a tubing adaptor 17 which is used to affix the horizontal member 16 to the slightly inclined (approximately 11 degrees) input port 3.

Referring again to FIG. 3, the vacuum 13 is provided with a cover 5 which is easily removed to allow access to the vacuum chambers 1,2. The vacuum 13 is provided with cover clamps 6, which maintains an air-tight joint, allowing a vacuum to be maintained during normal operation. When the cover 5 is open, the interior vacuum chambers 1,2 are visible, as seen in FIG. 4.

Figure 5:
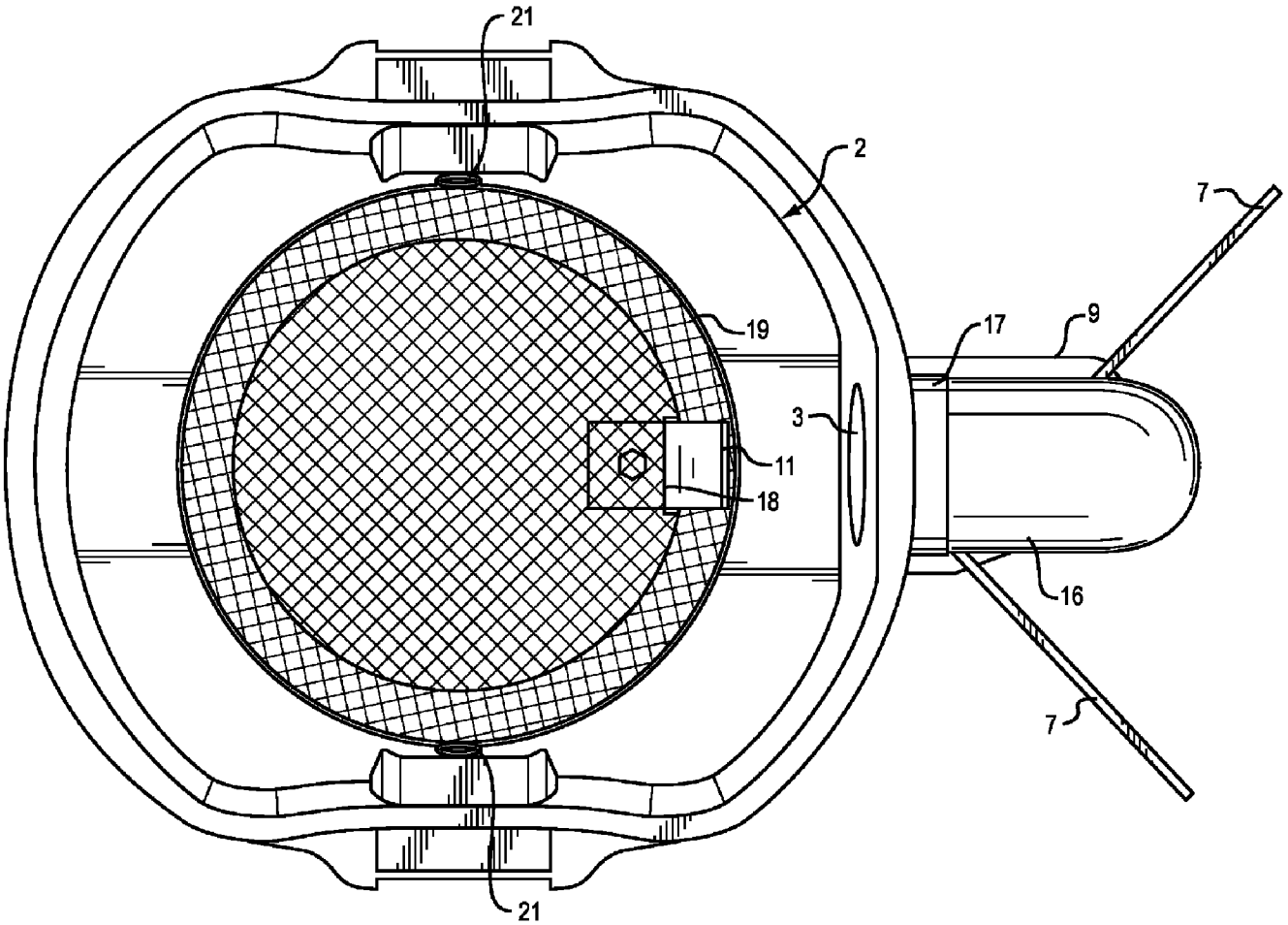
FIG. 5 is a top view of the lower chamber having a basket with a handle positioned therein and showing the diverter passing through a slot in the bottom of the basket.

Referring to FIG. 5, a top view of the lower chamber is shown having a basket 19 with a handle 21 positioned therein. In operation the Collector 10 contains the basket 19, which holds the tennis balls 14 and the Collector 10 picks up the tennis balls 14 by the suction created within the vacuum chambers 1,2. The basket 19 may be lifted out to gain access to the tennis balls 14, which may be either handled manually, or loaded into a Lobster®, or equivalent tennis ball machine, etc. It should be noted that the diverter 11 fits into a slot 18 cut into the bottom of the basket 19 to align the basket 19 within the vacuum chambers 1,2.

Figure 6:
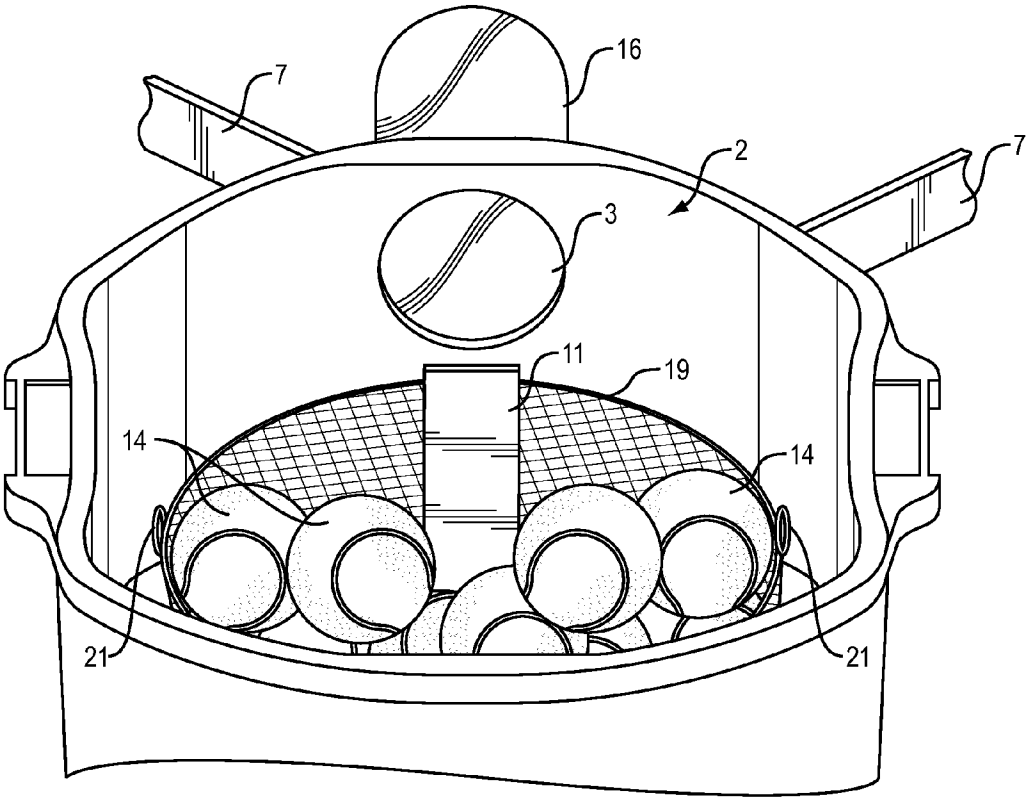
FIG. 6 is a top perspective view of the lower chamber of the vacuum collector showing the port for tennis balls to enter the chamber and the tennis balls disposed in the basket.

During operation, prototypes of the Collector 10 have been shown to collect balls at a rate of up to 5 balls per second. Another embodiment of the Collector 10 holds up to 150 balls, which is the capacity of a Lobster® tennis ball machine. FIG. 6 is a top perspective view of the chamber 2 of the vacuum collector showing the tennis balls 14 disposed within the basket 19 and showing the input port 3 where the balls enter the upper vacuum chamber 2.

Other features of the Collector 10 include an automatic shutoff switch attached inside the cover 5 which disengages a vacuum motor when the Collector 10 is full and ready to be emptied. Another feature is the clear window 26 located on the side of the cover 5 to show users how much space remains in the chamber for additional ball collection. Heavy-duty latches 6 attaching the cover 5 to the vacuum chambers 1,2 provide durability that is capable of 25,000 open/close cycles.

This invention has been disclosed in terms of a preferred embodiment. It will be apparent that many modifications can be made to the disclosed tennis ball vacuum collector 10 without departing from the invention. For example, the Collector 10 and method described herein are also applicable to the collection of other spherical balls, such as baseballs, etc. Therefore, it is the intent of the appended claims to cover all such variations and modifications as come within the true spirit and scope of this invention.

What is claimed is:

1. A ball collector comprising:

means for generating a vacuum at a port of said ball collector;

means for funneling a plurality of balls on a floor to a central location; and cylindrical means for transporting each of said balls from said central location to said port and into said ball collector for storage.

2. The ball collector as recited in claim 1 wherein:

said funneling means comprises collection members attached to a support bracket forming an angle for moving said plurality of balls towards said central location for vacuum suctioning each of said tennis balls through said cylindrical means.

3. A tennis ball vacuum collector comprising:

a vacuum device having an internal chamber;

a support bracket attached to said vacuum device below an input port;

a pair of collection members attached to said support bracket forming an angle for moving tennis balls toward a location adjacent to said support bracket for vacuum suctioning said tennis balls into said internal chamber; and cylindrical means having a portion of a lower end positioned within said support bracket and between said pair of collection members said lower end being open, and an upper end of said cylindrical means extending to said input port.

4. The collector as recited in claim 3 wherein said internal chamber comprises a removable basket.

5. The collector as recited in claim 3 wherein said internal chamber comprises a diverter attached to a bottom of said chamber and extending upward to a height of said input port for diverting said balls as they enter said chamber via said input port.

6. The collector as recited in claim 3 wherein said cylindrical means comprises a first portion extending vertically and a second portion having a right angle section extending horizontally into said input port.

7. The collector as recited in claim 6 wherein said input port comprises a cylindrical adaptor attached thereto for providing approximately an eleven degree angle transition downward to connect with said horizontal second portion of said cylindrical means.

8. The collector as recited in claim 3 wherein said vacuum device comprises a plurality of wheels and a handle to allow said collector to be easily moved along a floor or tennis court.

9. The collector as recited in claim 3 wherein said collection members provide an area of coverage of approximately two to three feet as said collector is moved forward.

10. The collector as recited in claim 3 wherein said vacuum device comprises a window on a side portion of a cover for viewing balls in said internal chamber.

11. The collector as recited in claim 3 wherein each of said collection members comprises attachment means for enabling said collection members to rotate upward when said collector is not in use.

12. The method as recited in claim 11 wherein said step of attaching a pair of collection members to said support bracket comprises the step of providing an area of coverage of approximately two to three feet as said collector is moved forward.

13. A method of making a tennis ball vacuum collector comprising the steps of providing a vacuum device having an internal chamber;

attaching a support bracket to said vacuum device below an input port;

attaching a pair of collection members to said support bracket forming an angle for moving tennis balls toward a location adjacent to said support bracket for vacuum suctioning said balls into said internal chamber; and positioning a cylindrical means having a portion of a lower end secured within said support bracket between said pair of collection members, said lower end being open, and an upper end of said cylindrical means extending to said input port.

14. The method as recited in claim 13 wherein said step of providing a vacuum device having an internal chamber comprises the step of providing a removable basket in said internal chamber.

15. The method as recited in claim 13 wherein said step of providing a vacuum chamber having an internal chamber comprises the step of attaching a diverter to the bottom of said chamber, said diverter extending upward to a height of said input port for diverting said balls as they enter said chamber via said input port.

16. The method as recited in claim 13 wherein said step of positioning said cylindrical means comprises the step of extending a first portion of said cylindrical means vertically and extending a second portion of said cylindrical means horizontally into said input port.

17. The method as recited in claim 16 wherein said method comprises the step of providing said input port with a cylindrical adaptor having an approximately eleven degree angle transitioning to meet a horizontal portion of said cylindrical means.

18. The method as recited in claim 13 wherein said step of providing a vacuum device comprises the step of providing a plurality of wheels and a handle on said vacuum device to allow said ball collector to be easily moved along a floor or tennis court.

19. The method as recited in claim 13 wherein said method comprises the step of rotating upward each of said collection members when said collector is not in use.

* * * * *

UNITED STATES PATENT AND TRADEMARK OFFICE
Certificate

Patent No. 8,313,396 B1 Patented: November 20, 2012

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Charles J. Mailman, Lexington, MA (US); and Robert A. Giunta, Stratton Mountain, VT (US).

Signed and Sealed this Twenty-fifth Day of November 2014.

EUGENE L. KIM
*Supervisory Patent Examiner*
Art Unit 3711
Technology Center 3700